US005129172A

United States Patent [19]

Brennan

[11] Patent Number: 5,129,172

[45] Date of Patent: Jul. 14, 1992

[54] SLIDE SAFETY STOP FOR PISTOLS AND OTHER SMALL ARMS

[75] Inventor: Edward J. Brennan, Andover, N.J.

[73] Assignee: The United States of America as represented by the Secretary of the Army, Washington, D.C.

[21] Appl. No.: 673,605

[22] Filed: Mar. 18, 1991

[51] Int. Cl.[5] ..... F41A 15/10; F41A 15/16

[52] U.S. Cl. ..... 42/25; 89/163

[58] Field of Search ..... 89/163, 196; 42/25

[56] References Cited

U.S. PATENT DOCUMENTS 2,926,445 3/1960 Green et al. ..... 42/25
3,014,303 12/1961 Brown et al. ..... 42/25

FOREIGN PATENT DOCUMENTS 319261 6/1989 European Pat. Off. ..... 89/196
20367 of 1911 United Kingdom ..... 89/196

*Primary Examiner*—Stephen M. Johnson
*Attorney, Agent, or Firm*—Anthony T. Lane; Edward Goldberg; Michael C. Sachs

[57] ABSTRACT

A safety stop for small arms having a slide, which keeps a catastrophic failure of the slide from causing shooter injury is disclosed. An improvement in the ejector and slide permit them to function together as a safety stop to prevent a broken slide from continuing off the back of the receiver in the event of catastrophic failure of the slide. A widened section on the ejector is accommodated in the ejector slot of the slide during normal firing of the weapon. An internal shoulder fixed relative to the slide and projecting into the ejector slot near the front of the slot is provided. Upon catastrophic slide failure during firing, the rear portion of the slide travels beyond its normally most rearward position and the internal shoulder engages the widened section of the ejector, stopping the rearward motion of the slide and precluding injury to the shooter.

1 Claim, 2 Drawing Sheets

SLIDE SAFETY STOP FOR PISTOLS AND OTHER SMALL ARMS

GOVERNMENT INTEREST

The invention described herein may be manufactured, used, and licensed by or for the Government for Government Purposes without payment to me of any royalties thereon.

BACKGROUND OF INVENTION

This invention is concerned with safety devices for firearms having a slide.

Testing of the M9 pistol uncovered a failure mode in this type of weapon. The slide may break into two separate pieces during firing with the rear portion of the broken slide continuing backward off the rear end of the receiver, striking the shooter and causing injury. The need exists for a safety device which will prevent injury to the shooter in this type of failure mode. The safety device must be easily adaptable to retrofit existing arms and not interfere with normal operation, or maintenance. Furthermore a retrofited firearm should require no special actions by the shooter to afford him the safety protection of the device. Operational form, fit and function of the firearm must be preserved. The incorporation of the device in new production (as opposed to retrofit applications) should not unnecessarily complicate component manufacturing or the firearm assembly process. Previous attempts to solve the problem were not adequate; they did not preserve the form, fit and function of the firearm and meet the specified retrofit criteria.

SUMMARY OF INVENTION

The present invention solves the aforementioned problem while meeting the stated criteria. The present invention is an improvement in firearms having a slide, and an ejector fixed with respect to the firearm. The improvement comprises an ejector and slide combination which together function as a safety stop to prevent a broken slide from continuing off the back of the receiver in the event of catastrophic failure of the slide during firing, protecting the shooter from injury associated with this type of firearm failure. In accordance with a first embodiment of the invention, an ejector having a widened section acts in combination with a slide having an ejector slot. The slide is constructed to accommodate the widened portion of the ejector in the ejector slot during normal travel of the slide and to engage the widened portion of the ejector should the slide travel beyond its normal rearward position such as movement associated with a catastrophic failure of the slide. The engagement of a failed slide with the widened portion of the ejector will prevent further rearward movement of the slide off the end of the receiver which may otherwise injure the shooter.

DESCRIPTION OF PREFERRED EMBODIMENT

Figure 1:
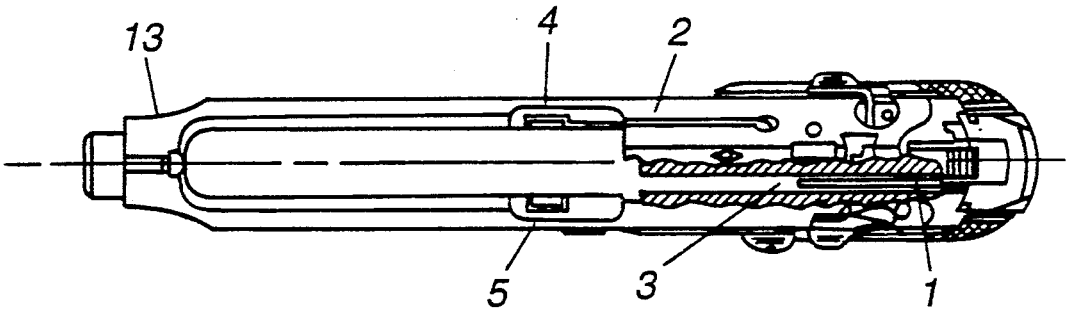
FIGURE 1 (PRIOR ART)
FIG. 1 is a top break-away view of a conventional U.S. 9 mm. M9 pistol showing its original slide and ejector.
Figure 2:
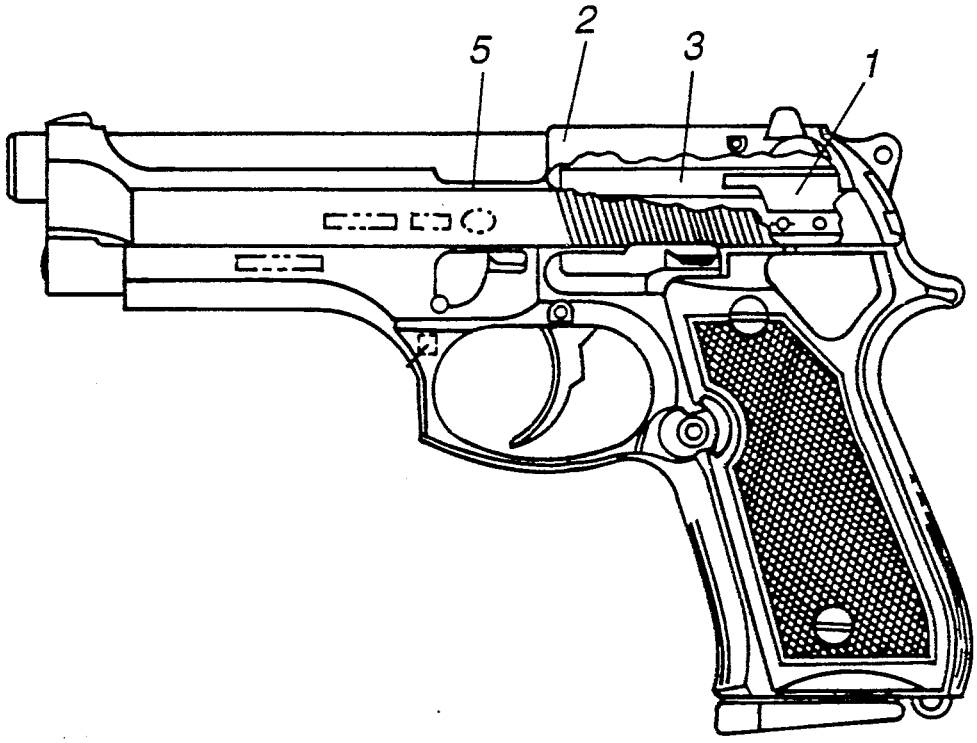
FIGURE 2 (PRIOR ART)
FIG. 2 is a left side break-away view of the U.S. 9 mm. M9 pistol showing its original slide and ejector.

Directions (front, rear, side, etc.) are referenced from positions in an assembled firearm. FIGS. 1 and 2 show a conventional U.S. 9 mm. M9 pistol with its frame in general (13) with its original ejector (1) and slide (2), the slide (2) having an ejector slot (3). If fracture of the slide occurs near points (4) and (5) during firing, the back half of the broken slide will move rearward with great velocity off the end of the receiver possibly causing injury to the shooter.

Figure 3:
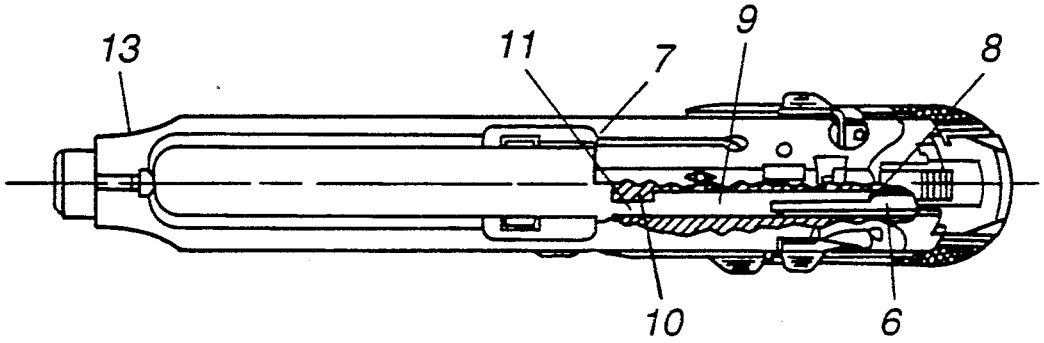
FIG. 3 is a top break-away view of the U.S. 9 mm. M9 pistol showing the improvement, a modified slide and ejector.

The improvement, a slide safety stop, uses a modified slide and ejector which cooperate with each other in the event of slide failure to safely stop the slide before the failed slide leaves the receiver. The improvement is made as follows: Referring to FIG. 3, the M9 pistol is retrofitted with a modified ejector (6) and a modified slide (7). The modified ejector (6), preferably but not necessarily of integral construction, has a widened side portion, preferably an external side projection (8), near the rear end of the ejector. A modified ejector slot (9) is machined into the slide to accommodate, preferably with a loose running fit, the widened side portion of the ejector during normal relative movement of the slide and ejector during firing of the weapon. An internal shoulder (10) is left near the front end of the slot to create a section of the slot (11) which is narrower than the widened side section (8) but wide enough to accommodate the unwidened front of the ejector. An equivalent to internal shoulder (10) can be provided by making the ejector slot a uniform width and then pressing a pin through a drilled hole in the place where a narrow section of the slot is desired. The pin will then be fixed to the slide and project into the ejector slot to form a narrowed section of the ejector slot. The pin will perform the same function in the same way to achieve the same result and therefore be an equivalent internal shoulder.

Figure 4:
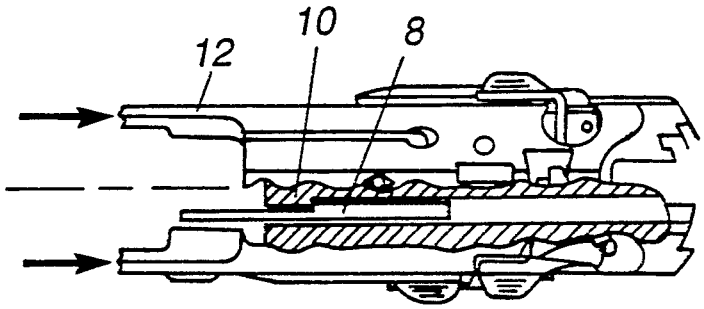
FIG. 4 is a view of a modified slide engaging the modified ejector after slide failure.
Figure 5:
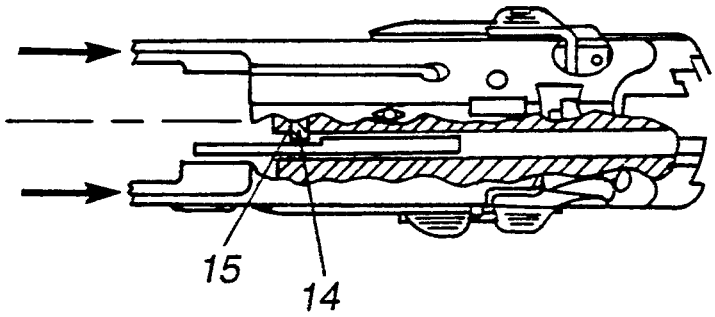
FIG. 5 is a view of another modified slide of FIG. 4, which uses a pin to help in stopping the slide ejector.

See pin (14) in hole (15) in FIG. 5 for example. FIG. 5 is like FIG. 4 except for the said pin and hole, instead of shoulder (10).

The assembled improved pistol is loaded and fired in its usual fashion. The user of the improved pistol will not notice the modification by external examination nor by firing during the normal operation of the weapon. Furthermore, dismantling and routine maintenance will be the same as for an unimproved pistol. Upon normal firing, the slide will move back from a first closed position to a second fully open position, ejecting the spent cartridge during this motion and returning forward to the first closed position in its usual manner. Referring to FIG. 4, should the slide (7) catastrophically fail during firing, the back half (12) would continue backward beyond the fully open position to a third abnormal position where internal shoulder (10) contacts widened section (8) stopping the rearward motion of the back half (12). If a catastrophic slide failure occurs, the pistol must be repaired, but the shooter will escape injury from this type of failure.

Although a single embodiment of the invention has been described in detail above, those skilled in the art can easily adapt the invention to other firearms having a slide and a fixed ejector, such as but not limited to, the M1911A1 pistol. Furthermore, those skilled in the art may make various modifications to the disclosed invention without affecting the spirit and scope thereof. These include substitutions which perform substantially the same function in substantially the same way to perform substantially the same result. It also includes the addition of superfluous material or components to the invention. It is understood that the scope of the invention is defined by the following claims:

What is claimed is:

1. An improved small firearm of the type having a frame, a slide and an ejector, said slide having an ejector slot, said ejector slot having a front end and a rear end, said ejector fixed with respect to said frame, said slide slideably mounted on said frame, said slide having a first forward fully closed normal position and a second back fully open normal position with respect to said frame, said ejector moving relative to said slide in said ejector slot when said slide moves from said first to said second position, wherein the improvement, a slide safety stop, comprises:

(a) a widened section on said ejector; and (b) an internal shoulder fixed to said slide, said internal shoulder projecting into said ejector slot near said front end of said slot, said internal shoulder engaging said widened section of said ejector during backward movement of said slide beyond said second position, said internal shoulder comprising a pin, said pin having a first end and a second end, said first end fixedly attached to said slide, said second end projecting into said ejector slot.

* * * * *